United States Patent [19]

Reppel

[11] Patent Number: 4,763,965

[45] Date of Patent: Aug. 16, 1988

[54] PRINTER TABLE WITH A PAPER CARRIAGE

[75] Inventor: Paul Reppel, Rönsahl, Fed. Rep. of Germany

[73] Assignee: Reppel-Plastic GmbH, Kierspe, Fed. Rep. of Germany

[21] Appl. No.: 886,025

[22] Filed: Jul. 15, 1986

[30] Foreign Application Priority Data

Aug. 31, 1985 [DE] Fed. Rep. of Germany ..... 3531188

[51] Int. Cl.[4] ..... A47B 21/00

[52] U.S. Cl. ..... 312/317 A; 312/201; 312/208

[58] Field of Search ..... 312/208, 282, 330 R, 312/250, 317 A, 201, 205

[56] References Cited

U.S. PATENT DOCUMENTS

| | | | |
|---|---|---|---|
| 739,662 | 9/1903 | Francisco et al. | 312/282 X |
| 2,657,968 | 11/1953 | Soehner | 312/330 R |

FOREIGN PATENT DOCUMENTS

| | | | |
|---|---|---|---|
| 226911 | 4/1963 | Austria | 312/317 A |
| 0168885 | 1/1986 | European Pat. Off. . | |
| 800898 | 12/1950 | Fed. Rep. of Germany | 312/317 A |
| 829776 | 1/1952 | Fed. Rep. of Germany | 312/330 R |
| 3346840 | 7/1985 | Fed. Rep. of Germany . | |
| 28394 | 2/1983 | Japan . | |
| 224770 | 12/1983 | Japan . | |
| 86/03458 | 6/1986 | World Int. Prop. O. . | |
| 477158 | 12/1937 | United Kingdom | 312/317 A |

*Primary Examiner*—Kenneth J. Dorner
*Assistant Examiner*—Thomas A. Rendos
*Attorney, Agent, or Firm*—Edwin D. Schindler

[57] ABSTRACT

The invention provides a printer table with a paper carriage, such that, at least, four grades of paper can be held in readiness without difficulty, each of them properly arranged for feeding. The paper carriage is able to be inserted beneath the printer table. The printer table has a bottom frame, open at one wide side, with a traverse element at the opposite broadside (or wide side) and vertical posts at the four corners of the bottom frame. The width of the paper carriage corresponds to the distance between the two posts which define the limits of the open wide side of the printer table. The paper carriage includes one bottom or base plate or a plurality of bottom, or base, plates having raised edges.

5 Claims, 2 Drawing Sheets

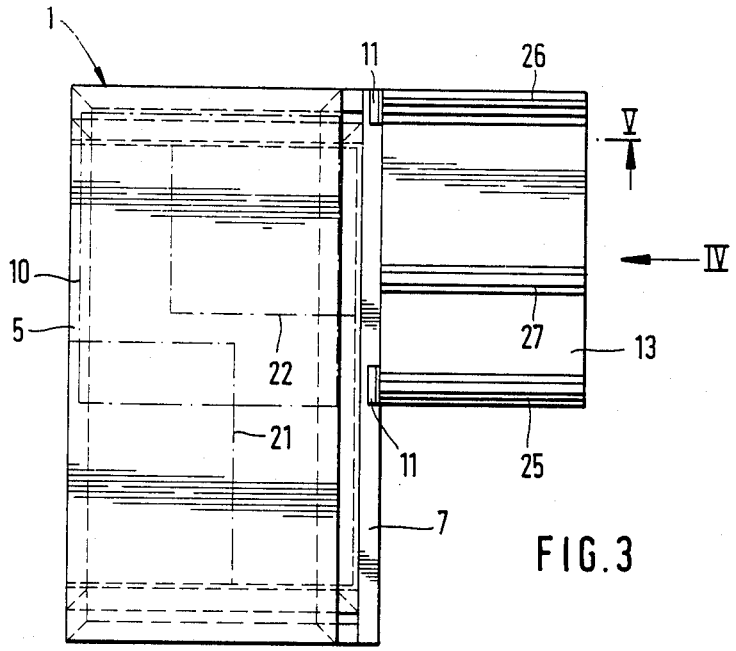
FIG. 3
FIG. 4
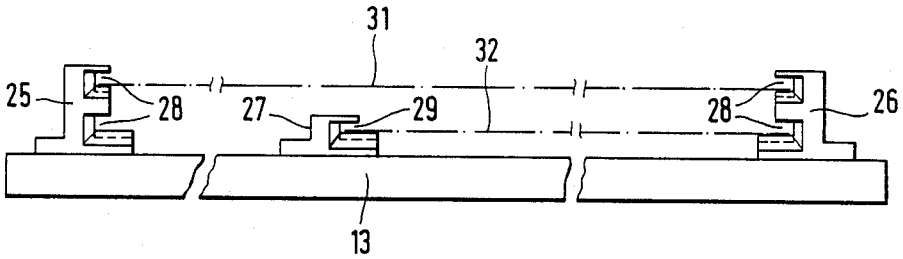
FIG. 5
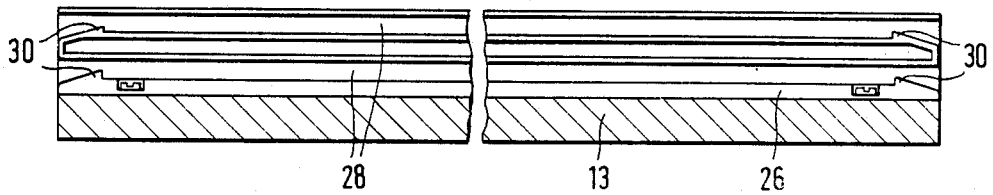

PRINTER TABLE WITH A PAPER CARRIAGE

BACKGROUND OF THE INVENTION

1. Field of the Invention

The invention relates to a printer table with a paper carriage, where the paper carriage is capable of being inserted under the printer table.

2. Description of the Prior Art

In printer tables known to the prior art, the manipulation of the stack of paper in connection with the paper carriage is quite cumbersome. The paper carriage is insufficiently adapted to changes of different kinds of paper, especially different sizes.

SUMMARY OF THE INVENTION

An object of the present invention is to provide a printer table with a paper carriage which can be constructed so that, at least, four grades of paper can be held in readiness without difficulty; each of them properly arranged for feeding.

The foregoing and related objects are met in accordance with the invention, which provides for a printer table having a bottom frame open at one wide side, with a traverse element at the opposite wide side and vertical posts at the four corners of the bottom frame. The width of the paper carriage corresponds to the distance between the two posts of the printer table which define the limits of the open wide side. The paper carriage has one or more base plates with raised edges.

The invention differs from the state of the art in that the paper carriage can be manipulated without effort. Different kinds of paper are held in readiness. To change to another kind of paper, all that is necessary is withdrawal of the paper carriage, which moves with ease on casters or rollers, and to introduce the paper carriage into a new alignment. The various sizes of paper are constrained to be arranged on the paper carriage properly and ready for feeding. A single alignment of the printer on the table thus guarantees the permanent alignment of the printer in the correct position. The manipulation of the individual and relatively heavy stacks of paper, when changing paper or paper size, is no longer necessary.

In order that continuous strips of paper can be fed from the stack of paper over the edge of the table without obstruction, the invention provides that the transverse bars of the bottom frame project beyond the posts on the side opposite the open wide side and are connected, at their ends, by a traverse element serving as a stop for the paper carriage.

A proper and orderly depositing of the printer paper is possible by having the traverse element carry a reception plate.

The space required by the printer table for stowing is reduced by having the reception plate pivotable on folding hinges. In this manner, the printer table can be easily stowed away.

An orderly depositing of differnt sizes of printed paper is rendered possible by having guide rails with one or two insertions, or slide-in grooves arranged on the reception plate; two of such guide rails, each with two insertion grooves, being arranged opposite to one another and one guide rail, with one insertion groove, being in an intermediate region, and being positioned opposite one of the two aforesaid guide rails.

BRIEF DESCRIPTION OF THE DRAWING

An embodiment of the present invention will be described in detail, with reference to the accompanying drawing, wherein:

FIG. 3 is a plan view corresponding to FIG. 1;

FIG. 4 is a view of the reception plate as viewed in the direction of arrow IV; and FIG. 5 is a sectional view taken along line V.

DETAILED DESCRIPTION OF THE PREFERRED EMBODIMENT

Figure 1:
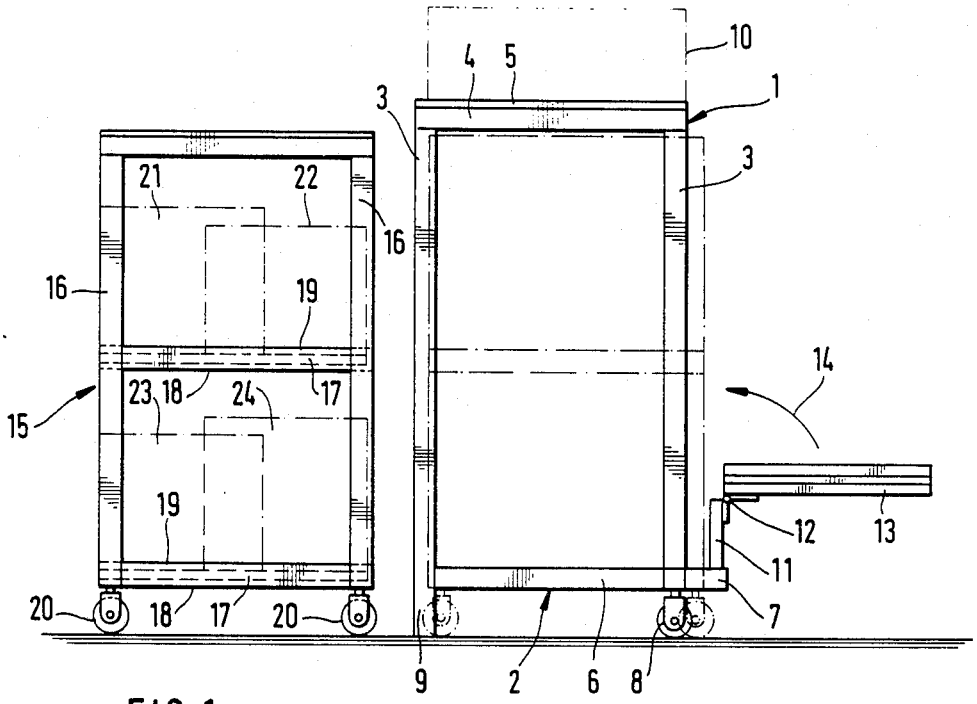
FIG. 1 is a side view of a printer table of the invention with a paper carriage.

Turning now, in detail, to the drawing, FIG. 1 shows a printer table 1 with a bottom frame 2, vertical posts 3, in the four corners of bottom frame 2, an upper frame 4 and a table plate 5. The bottom frame 2 comprises two transverse bars 6 arranged opposite each other, each of which projects on one side beyond a post 3. A traverse element 7, connects traverse bars 6 and is offset from posts 3 by the length, or projection, of traverse bars 6. The bottom frame is open at the side opposite the traverse element so that, in accordance with FIG. 2, the entire space below the upper frame 4 is readily and freely accessible. Rollers 8 are mounted on the bottom frame 2 in the vicinity of traverse element 7. At the opposite and open side of the bottom frame, posts 3 are extended by supporting legs 9. If desired, rollers may also be provided there.

Table plate 5 holds a printer 10, which is represented by a dot-dash line. Printer 10 is aligned along one edge of the table plate 5. According to FIG. 2, printer 10 is aligned on the right-hand edge of printer table 1.

Supports 11, each having a folding hinge 12, are arranged on transverse element 7. The folding hinges 12 carry a reception plate 13, which holds a drawer for the printer paper coming from the printer. This will be further explained in detail below. The folding hinges 12 each have one stop so that the reception plate 13 is positioned in the horizontal alignment, as shown in FIG. 1. The reception plate 13 can be folded upward in the direction of arrow 14.

A paper carriage 15 comprises a frame construction with four posts 16 and a plurality of bottom, or base plates 17, whose frames 18, are each surrounded by raised edges 19. The raised edges 19 exist as a continuous periphery on all four sides of each base plate 17. The frame 18 is preferably constructed from L-shaped angle rods. The paper carriage 15 stands on four rollers 20 so that paper carriage 15 can be moved. The height and the width of paper carriage 15 are adapted to the size of the opening existing at the open side of the bottom frame 2, beneath upper frame 4 of printer table 1 so that the paper carriage can be inserted into printer table 1 from the open side without effort, and there is room for it within the printer table, as can be seen from FIGS. 1 to 3.

Each base plate 17 of the paper carriage 15 accepts two stacks of paper 21, 22, 23, 24 of different sizes. The stacks of paper comprise, in the usual manner, contiguous and folded sheets of paper in continuous form. It may be seen from the Figure that the papers have differnt sizes. Each stack of paper may also be placed on the base plate 17 together with the packaging carton. Each stack of paper is set in place, at one corner of the paper carriage, at raised edges 19, so that the particular stack of paper is aligned on one corner of the paper carriage. Thus, after the paper carriage is inserted beneath the printer table, one stack of paper (22 or 24) is aligned on the printer 10, ready to feed, and the paper may, in each case, be introduced into the printer 10 in the proper position. With the orientation according to FIG. 2, paper from the stack of paper 22 or 24 can be fed to the printer 10. The paper runs over the table edge without obstruction since the paper carriage 15, positioned against the transverse element 7, projects beyond the edge of the table. A single adjustment is sufficient in order to assure a feed in the proper position. If the stacks of paper 21 or 23 are to be used, it is only necessary that the paper carriage 15 be withdrawn from the printer table and rotated 180. After that, the paper carriage is again moved into the printer table.

The paper is guided from the stack of paper 22 to the printer 10 in the usual manner, and it proceeds out of the printer in the printer condition. The continuous paper then moves to the reception late 13.

Figure 2:
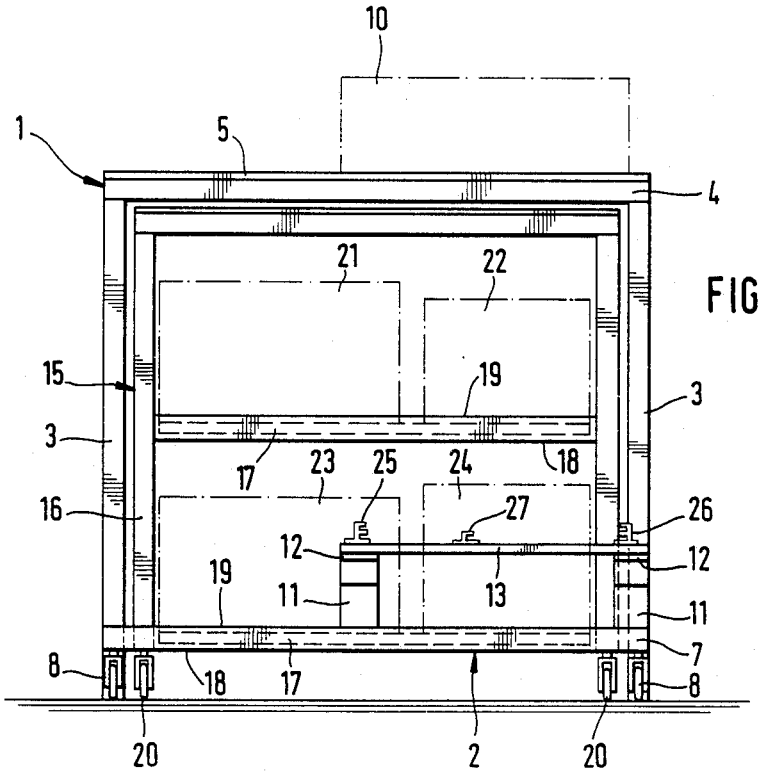
FIG. 2 is a front view corresponding to FIG. 1.

FIGS. 1 through 3 show the different paper sizes. Normally, two paper sizes are used. Corresponding to these paper sizes, drawers are available to the user, which drawers can be stored in file cabinets. The reception plate is contructed for the reception of each of these drawers.

According to FIGS. 4 and 5, three guide rails 25, 26 and 27 are arranged on the reception plate 13. Guide rails 25 and 26 are of the same construction and have two guide grooves 28. The guide rail 27 has only one guide groove 29, which is adapted in height to the lower guide groove 28. In the longitudinal direction of the guide grooves, stop noses (or projections) 30 are provided in each case.

The guide rails 25 and 26 are arranged at a distance from each other which corresponds to the dimensions of a drawer 31, as indicated schematically in FIG. 4. Drawer 31 is provided for holding paper having a width of 390 mm. According to the illustration of FIG. 4, drawer 31 is inserted in each case into the upper guide grooves. Guide rail 27 is opposite guide rail 26 at a distance from it such that drawer 31 for paper, having a width of 250 mm, can be inserted into the guide grooves 28 and 29. Guide groove 29 is aligned to the lower guide groove 28.

I claim:

1. A printer table, comprising:

a paper carriage, adapted for bearing stacks of paper, which is capable of being inserted beneath said printer table, said printer table having at least one base plate with raised edges;

a bottom frame, having four corners and being open on a first wide side, includes at least one traverse bar located at a second wide side, said second wide side being positioned opposite said first wide side;

a traverse element being located at said second wide side;

vertical posts located at the four corners of said bottom frame so that the width of said paper carriage corresponds to a distance between two of said vertical posts which define the limits of the open, first wide side, whereby, said traverse bar of said bottom frame projects beyond said vertical posts, said traverse bar being connected at an end by means of said traverse element, said tranverse element serving as a step for said paper carriage.

2. The printer table according to claim 1, wherein said traverse element retains a reception plate.

3. The printer table according to claim 2, wherein said reception plate is pivotable on at least one folding hinge.

4. The printer table according to claim 3, wherein said reception plate includes guide rails, with insertion grooves, which are arranged on said reception plate wherein two of said guide rails, each having two of said insertion grooves, are arranged opposite to one another, and a third guide rail, having one of said insertion grooves, is arranged in an immediate region and is located opposite to one of the first two of said guide rails.

5. The printer table according to claim 2, wherein said reception plate includes guide rails, with insertion grooves, which are arranged on said reception plate wherein two of said guide rails, each having two of said insertion grooves, are arranged opposite to one another, and a third guide rail, having one of said insertion grooves, is arranged in an immediate region and is located opposite to one of the first two of said guide rails.

* * * * *